United States Patent [19]

Gwyn et al.

[11] 4,320,795

[45] * Mar. 23, 1982

[54] PROCESS FOR HEAT TRANSFER WITH DILUTE PHASE FLUIDIZED BED

[75] Inventors: John E. Gwyn, Katy; Scott C. Roberts, Houston, both of Tex.

[73] Assignee: Shell Oil Company, Houston, Tex.

[ * ] Notice: The portion of the term of this patent subsequent to Aug. 29, 1995, has been disclaimed.

[21] Appl. No.: 777,197

[22] Filed: Mar. 14, 1977

Related U.S. Application Data

[63] Continuation-in-part of Ser. No. 593,403, Jul. 7, 1975, abandoned.

[51] Int. Cl.[3] ..... C10B 49/22; C10B 53/06; F28D 13/00

[52] U.S. Cl. ..... 165/1; 165/104.16; 165/111; 201/12; 201/16; 201/31; 208/11 R

[58] Field of Search ..... 201/3, 4, 8, 12, 16, 201/31, 44; 165/104 F, 1, 111, 104.16; 23/283, 288 S, 284; 208/8, 11 R; 422/145–147, 206, 213, 215, 223

[56] References Cited

U.S. PATENT DOCUMENTS

| | | | |
|---|---|---|---|
| 2,725,348 | 11/1955 | Martin et al. | 23/288 S |
| 2,741,549 | 4/1956 | Russell | 48/206 |
| 2,743,216 | 4/1956 | Jahnig et al. | 201/12 |
| 2,776,935 | 1/1957 | Jahnig et al. | 201/12 |
| 2,955,077 | 10/1960 | Welinsky | 201/31 |
| 3,855,070 | 12/1974 | Squires | 201/31 |
| 3,921,307 | 11/1975 | Marek et al. | 165/104 F |
| 4,064,018 | 12/1977 | Choi | 201/31 |

FOREIGN PATENT DOCUMENTS

| | | | |
|---|---|---|---|
| 1487133 | 7/1966 | France | 165/104 F |

*Primary Examiner*—Bradley Garris

[57] ABSTRACT

A process for the transfer of heat between solids is described in which a particulate solid is allowed to fall at a substantially uniform rate through a dilute phase fluidized bed of another particulate solid.

4 Claims, No Drawings

PROCESS FOR HEAT TRANSFER WITH DILUTE PHASE FLUIDIZED BED

This application is a continuation-in-part of application Ser. No. 593,403, filed Jul. 7, 1975, now abandoned.

BACKGROUND OF THE INVENTION

Many processes are in use where heat transfer to and from particulate solids is an important unit operation. With the resurgence of the synthetic fuels industry and increasing usage of calcined lime for $SO_2$ control, this unit operation will become even more important. However, high fuel costs and conservation efforts dictate that these processes achieve a high degree of thermal efficiency.

Generally speaking, in order to achieve efficient heat exchange, countercurrent operation or highly staged operation is required. The latter option can be quite expensive; thus the number of stages is usually limited to two or three and heat efficiency is sacrificed. Countercurrent operation, which is used extensively for gas/liquid, gas/gas, and liquid/liquid heat exchange, is both efficient and relatively inexpensive. Nonetheless, countercurrent heat exchange between solids is rarely employed, for a variety of reasons.

U.S. Pat. No. 2,725,348 discloses a process in which solid heat carrier particles may be permitted to fall more or less freely through a fluidized mass of process solids at a velocity controlled by that of the fluidizing gases. However, the employment by the patentees of a dense fluidized bed renders the process unattractive from the standpoint of thermal efficiency. The present invention overcomes this deficiency and provides a method of heat transfer between solids which is thermally efficient.

SUMMARY OF THE INVENTION

Accordingly, the invention comprises a process for the transfer of heat between two solids, one finely divided and capable of fluidization and the other larger and dense enough to fall through a fluidized bed of the first solid. Either or both of the solids may be the process material to be heated or cooled. Typically, one solid may be a heat carrier which transports heat from another solid or gaseous stream to the process solid; however, both solids may be process solids provided the size ranges are sufficiently different to permit countercurrent flow.

In summary, the invention, in one embodiment, relates to a process for the transfer of heat between solid materials comprising, providing a relatively hot particulate heat carrier, countercurrently contacting a solid material subdivided to a particle size fluidizable in gas in the form of an upwardly moving dilute phase fluidized mass in gas in a vertically-oriented heat exchange zone with the relatively hot particulate heat carrier, the heat carrier being introduced in the upper portion of the heat exchange zone and having a particle size and density such that it falls through the dilute phase fluidized mass at a substantially uniform rate, and collects in the lower portion of the heat exchange zone as a relatively cool particulate heat carrier, the contacting producing a solid material at elevated temperature, and removing the relatively cool heat carrier and the solid material at elevated temperature from the heat exchange zone.

In another embodiment, the invention comprises a process for the transfer of heat between solid particles comprising, providing a relatively cool particulate heat carrier, countercurrently contacting a solid material having an elevated temperature and subdivided to a particle size fluidizable in gas in the form of a relatively hot upwardly moving dilute phase fluidized mass in gas in a vertically-oriented heat exchange zone with the relatively cool particulate heat carrier, the heat carrier being introduced in the upper portion of the heat exchange zone and having a particle size and density such that it falls through the dilute phase fluidized mass at a substantially uniform rate, and collects in the lower portion of the heat exchange zone as a relatively warm particulate heat carrier, the contacting producing a relatively cool solid material, and removing the relatively warm heat carrier and the relatively cool solid material from the heat exchange zone.

DETAILED DESCRIPTION OF THE INVENTION

For simplicity, the invention will be described in the context wherein the material introduced in the upper portion of the vertical heat exchange zone has the greater heat content, the material being introduced as the dilute-phase fluidized mass in gas in the lower portion of the zone being the cooler material to which it is desired to impart heat. Those skilled in the art will recognize, of course, as indicated above, that the material introduced in the upper portion of the heat exchange zone may be the material to which it is desired to impart heat from a dilute-phase fluidized mass at higher temperature.

Accordingly, this embodiment is carried out in a vertically-oriented process zone wherein relatively cool subdivided solid material in the form of an upwardly moving, dilute-phase fluidized mass in gas is contacted countercurrently with a relatively hot, particulate heat carrier to effect sensible heat transfer to the solid material and heat the solid to an elevated temperature. This dilute-phase fluidized bed condition is created when the fluidizing gas velocity exceeds a critical velocity known in the art as the "dilute-phase transition velocity", e.g., see U.S. Pat. No. 3,597,327 and U.S. Pat. No. 3,855,070. At this critical velocity, which is preferably less than 10 times greater than the minimum fluidization velocity for the subdivided solid material employed, the fluidized bed density abruptly decreases with a concomitant increase in net upwards velocity of the bulk of the fluidized subdivided solids in the bed. Under these conditions, the fluidized bed thins out in a vertical direction and the path traveled by any given fluidized particle becomes less random and more fixed in the direction of fluidizing gas flow, though a certain amount of refluxing is still encountered due to the formation of stringers of fluidized particles in the bed which quickly diffuse into the upwardly moving fluidizing gas. The net effect of such dilute phase fluidization is to regularize the rate of movement of any given fluidized particle through the fluidization stage, minimize backmixing of fluidized particles and place limits on residence time in the fluidized bed process zone since substantially all of the fluidized particles are thereby conveyed out the upper portion of the vertical process zone of the invention. For example, when subdivided oil shale or other solid materials of similar particle size and density are employed, a dilute-phase fluidized bed condition can be achieved with superficial fluidizing gas velocities of about 8 to 30 ft/sec and solids to fluidizing gas weight ratios of 6–20 to 1, with superficial gas velocities of 10 to 25 ft/sec and solids to gas ratios of 8–20 to 1 being preferred. With these process parameters, the apparent fluidized bed densities suitably range from 1–5 lb/ft$^3$ with densities in the range of 2–4 lb/ft$^3$ being preferred.

The type of fluidizing gas employed in this stage of the process is not critical provided it is not detrimental to or otherwise reacts with and substantially depletes the solids being processed at the temperatures achieved in transfer. Suitable non-interfering fluidizing gases include dilute oxygen-containing gases such as air or flue gas-diluted air, flue gas and inert gas such as nitrogen. It is preferred to employ a dilute oxygen-containing gas such as air.

In the process of the invention, countercurrent contact and sensible heat transfer from the relatively hot, particulate heat carrier to the relatively cool, subdivided solid is established by introducing the particulate heat carrier at the top or upper portion of a vertical process zone and passing it in a downward direction at a uniform rate through the upwardly moving dilute-phase fluidized bed of subdivided solid material. That is, the particulate heat carrier, usually in the form of spheres, pellets or granules, is introduced at a controlled rate uniformly across the cross-section of a top region of the process zone via suitable deflecting device and allowed to fall or rain at a substantially uniform, non-accelerating rate under the influence of gravity against the rising stream of fluidized solid material. Designation of the flow of particulate heat carrier in this manner is intended to denote that the individual carrier particles cascade or fall under the influence of gravitational force at apparent bed densities sufficiently low that free movement of the heat carrier particles is not restricted by carrier particle population in the zone, thereby precluding the use of a dense, downwardly moving bed of heat carrier particles. Further, the rate of carrier particle descent through the bed is controlled to a sufficient degree by the opposing fluidizing gas force that it does not continuously accelerate with the action of gravitational force. Under these conditions the heat carrier particles experience a certain amount of sideways and even upwards movement on their descent through the fluidized bed; however, the net flow is in a downwards direction at a substantially uniform rate and backmixing is minimized due to the rate of upward movement of subdivided solid material in the dilute fluidized phase. For counter-current contact of a dilute-phase fluidized bed of subdivided oil shale or other like material according to the invention, the apparent heat carrier densities in the heating zone will generally range from 1 to 14 lbs/ft$^3$, with resultant heat carrier falling velocities of about 1 to 10 ft/sec in order to obtain the desired heat carrier flow characteristics.

The flow or rate of descent of the particulate heat carrier through the heating zone according to the invention is controlled by several factors well known to those skilled in the art. Principal factors include the particle size and density or specific gravity of the heat carrier particles, the fluidized particle bed density and the opposing fluidizing gas velocity. The fluidizing gas velocity, of course, will vary with the specific type of subdivided solid material feedstock employed. With the aforementioned fluidizing gas velocities for the preferred oil shale feedstock and other materials of like particle size and specific gravity, it is desirable to employ heat carriers having a specific gravity of from 2 to 8 and a particle size in the range of 1/16" to $\frac{3}{8}$". In any case, it is preferable that the particle size of the heat carrier be larger by a factor of at least two over the particle size of the subdivided solid material to insure effective countercurrent contact and adequate separation of heat carrier from subdivided solid material. It is desirable to use heat carriers having as small as possible particle size to maximize heat transfer. In this same regard, it is desirable to use a heat carrier having as high a heat capacity as possible. Suitable heat carriers have heat capacities in excess of 0.10 btu/lb/°F. with carriers having capacities in the range of 0.12 to 0.25 btu/lb/°F. being preferred.

The composition of the heat carrier employed in the instant process is rather conventional, and includes any solid material having the above-mentioned heat capacity which is relatively inert to chemical and physical degradation in the process. Suitable materials include aluminum, iron, steel and lead alloys, ceramic materials such as high-density alumina and naturally occuring silica-containing materials such as gravel. Pea gravel possesses a suitable high heat capacity and can be employed in the instant process. Most preferred, because of their high-heat capacities, high densities and resistance to chemical and physical degradation, are the ceramic materials such as high-density alumina.

As indicated, the process of the invention is generally applicable to the transfer of heat to and from any solid material which can be subdivided into a particle size fluidizable in gas. Suitable solid materials include mined oil shale, various coals and lignite, wood and bark waste, agricultural residues, biotreater sludges, industrial and municipal solid wastes and the like. Preferred solid material feedstocks for the process include oil shale, coals such as anthracite, bituminous and subbituminous and lignite. In many cases, however, there will not be two suitably sized process materials available for convenient heat exchange. Therein, usage of an independent heat carrier is preferred. Two heat exchangers may then be employed: one to heat the carrier and one to cool it. This combination is particularly useful in cases where heat can be recovered from a hot solid output from a process and used to preheat the solid process feed. This technique can greatly reduce the fuel requirements of a process and can economically recover low level heat (150°–500° F.) which is usually discarded.

The process of the invention may also be used to heat or cool solids and even to dry or remove solvent from solids. Chemical reactions may also be carried on, provided they are sufficiently fast and do not consume or produce excessive quantities of the transport gas. Examples of usage where both solids are process materials include preheating or drying of a coarse coal feed with hot finely divided carbonization, liquefaction or gasification residue, and preheating of a coarse limestone feed to calcining operation with the crushed hot product.

One of the solid materials employed must be subdivided or comminuted to a particle size fluidizable in gas. If the solid material is not in such form, standard techniques may be employed to reduce the size, as needed. For example, the feedstock may be ground or crushed to the desired particle size. In the case of preferred feedstocks such as oil shale, it is desirable to employ conventional grinding devices such as ball mills with provision being made to separate and recycle coarse materials back through the ball mill. Separation of shale of the desired particle size from the oversize may be accomplished by elutriation with gas or by screening with the remaining coarse shale being conveyed back to the grinder. In the case of softer and more malleable feedstocks such as wood and bark waste, the desired comminution n is more readily obtained with a crushing or chopping device such as a hammer mill. The specific particle size to which the solid feedstock is reduced will depend to a certain degree on the bulk density of the feedstock. For mined oil shale and other materials having specific gravities in the range of about 1 to 2.4, it is desirable to reduce the particle size of the largest particles to $\frac{1}{8}$" or less. This will produce a mass of particulate shale which is readily fluidizable at conventional fluidizing gas velocities. Preferably, the oil shale is ground to a particle size of 1/16" or less in order to promote separation of the solid shale particles from particulate heat carrier.

Average residence times in the heat exchange zone will vary depending on, inter alia, the temperature differential of the solids, the velocities of the solids, etc. Accordingly, specific ranges cannot be given. In general, however, satisfactory heat transfer between solids will normally be accomplished, given the conditions specified herein, employing residence times of from 10 to 50 seconds.

The vertically-oriented heat exchange zone according to the invention may be of conventional design, typically being in the form of a vertically-oriented column or standpipe with appropriate inlets and outlets for subdivided solid material and particulate heat carrier. Preferably, the heat exchange zone is in the form of a vertically-oriented, cylindrical column which is internally equipped with a plurality of baffles or grid plates to promote staging of the countercurrent heat exchange and minimize backmixing. When subdivided solid material feedstocks such as oil shale or coal are employed having significant water contents, it is most preferable to employ a vertical column which increases in diameter or internal cross-sectional area with increasing height to compensate for any increase in gas volume due to water vaporization. Suitable preheating zone designs in this case would include those having inverted cone shape and cylindrical columns whose internal diameter is increased in one or more stages in an upward direction. For practical scale heating of oil shale and like solid materials, the heat exchange zone is suitably 8 to 20 feet in diameter and 50 to 200 feet in height. Preferably, the height of the heat exchange zone is about 100 feet for oil shale heating according to the conditions described above. When baffles or grid staging are employed on a practical scale, it is preferable to use about 5 to 20 sets of baffles or horizontal grid plates spaced at uniform intervals of about 5 to 20 feet along the axis of the heat exchange zone.

If the fluidized mass of solid material is to transfer heat to cooler particulate material, the design of the heat exchange zone may be modified accordingly. Preferably, the heat exchange zone is in the form of a vertically-oriented column or standpipe having appropriate inlets and outlets for particulate material or heat carrier, the top or upper portion of the column being equipped with suitable deflecting device to distribute heat carrier flow uniformly across the column. In this case, however, it is preferred that the column reduce, rather than expand, in diameter with increasing height to compensate for contractions in fluidizing gas volume as it is cooled. Nonetheless, it is also preferred that the heat exchange zone be internally equipped with a plurality of baffles or grid plates to promote staging of the countercurrent heat exchange and to minimize backmixing. For practical scale heat exchange from retorted oil shale and like particulate residues, the heat exchange zone is suitably 8 to 20 feet in diameter and 50 to 200 feet in height. Preferably, the height of the heat exchange zone is about 100 feet for retorted oil shale cooling according to the conditions described above. When baffles or grid staging are employed on a practical scale, it is preferable to use about 5 to 20 sets of baffles or horizontal grid plates spaced at uniform intervals of about 5 to 20 feet along the axis of the heat exchange zone.

As an illustration of the process of the invention, raw crushed shale having a particle size of less than 1/16 inch is picked up by a fluidizing gas and introduced into the heat exchange zone of the invention and carried up in the form of a dilute-phase fluidized bed. In this embodiment the fluidizing gas is compressed air diluted with flue gas at about 170° F. Concomitant with the introduction of comminuted shale as a dilute-phase fluidized bed in the heat exchange zone, a particulate heat carrier in the form of $\frac{1}{4}$" diameter ceramic or $\frac{1}{8}$" steel balls having a zone inlet temperature of about 675° F. is introduced into the zone and rained downwardly at substantially uniform, non-accelerating rate under the influence of gravity through the dilute-phase fluidized bed. On entering the top portion of the heat exchange zone, the heat carrier balls impact on a conical deflector plate to distribute their flow uniformly over the cross-section of the heat exchange zone. Sensible heat exchange effected countercurrently in this zone raises the temperature of the fluidized oil shale particles to about 550° F. at the upper outlet top of the heat exchange zone. The particulate heat carrier, which falls at a substantially uniform rate under the influence of gravity through the dilute-phase fluidized bed, collects at the bottom of the zone at a temperature of about 100° F. as a result of sensible heat exchange with the incoming fluidized shale particles, and is removed.

While the invention has been illustrated with particular apparatus, those skilled in the art will appreciate that, except where specified, other equivalent or analogous units may be employed. The term "zones", as employed in the specification and claims, includes, where suitable, the use of segmented equipment operated in series, or the division of one unit into multiple units because of size constraints, etc. For example, the heat exchange zone might comprise two separate heat exchange columns in which the heat carrier falling to the lower portion of the first column would be introduced into the upper portion of the second column, the solid material from the upper portion of the second column being fed into the lower portion of the first column.

What is claimed is:

1. Process for the transfer of heat between solid materials comprising, providing a relatively hot particulate heat carrier, countercurrently contacting a solid material subdivided to a particle size fluidizable in gas in the form of an upwardly moving dilute phase fluidized mass in gas in a vertically-oriented heat exchange zone with the relatively hot particulate heat carrier, the heat carrier being introduced in the upper portion of the heat exchange zone and having a particle size and density such that it falls through the dilute phase fluidized mass at a substantially uniform rate, and collects in the lower portion of the heat exchange zone as a relatively cool particulate heat carrier, the contacting producing a solid material at elevated temperature, removing the relatively cool heat carrier, and removing the solid material at elevated temperature from the upper portion of the heat exchange zone.

2. Process for the transfer of heat between solid particles comprising, providing a relatively cool particulate heat carrier, countercurrently contacting a solid material having an elevated temperature and subdivided to a particle size fluidizable in gas in the form of a relatively hot upwardly moving dilute-phase fluidized mass in gas in a vertically-oriented heat exchange zone with the relatively cool particulate heat carrier, the heat carrier being introduced in the upper portion of the heat exchange zone and having a particle size and density such that it falls through the dilute phase fluidized mass at a substantially uniform rate, and collects in the lower portion of the heat exchange zone as a relatively warm particulate heat carrier, the contacting producing a relatively cool solid material, removing the relatively warm heat carrier, and removing the relatively cool solid material from the upper portion of the heat exchange zone.

3. The method of claim 1 wherein the subdivided solid material is oil shale.

4. The method of claim 2 wherein the subdivided solid material is oil shale.

* * * * *